US009470021B2

(12) United States Patent
Kindstrand et al.

(10) Patent No.: US 9,470,021 B2
(45) Date of Patent: Oct. 18, 2016

(54) TWISTABLE SECURITY CABLE

(71) Applicant: Schlage Lock Company LLC, Indianapolis, IN (US)

(72) Inventors: Daniel Hugh Kindstrand, Pembroke, MA (US); Donald H. Warren, Natick, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/558,423

(22) Filed: Dec. 2, 2014

(65) Prior Publication Data

US 2015/0152669 A1 Jun. 4, 2015

Related U.S. Application Data

(60) Provisional application No. 61/910,897, filed on Dec. 2, 2013.

(51) Int. Cl.

| | |
|---|---|
| ***E05B 67/00*** | (2006.01) |
| ***E05B 71/00*** | (2006.01) |
| ***E05B 73/00*** | (2006.01) |

(52) U.S. Cl.

CPC ..... *E05B 67/003* (2013.01); *E05B 71/00* (2013.01); *E05B 73/0005* (2013.01); *D07B 2201/2067* (2013.01); *Y10T 70/402* (2015.04)

(58) Field of Classification Search

CPC .... E05B 73/00; E05B 73/0005; E05B 67/00; E05B 67/003; E05B 67/06; E05B 69/00; D07B 1/00; D07B 1/005; D07B 2201/20; D07B 2201/2001; D07B 2201/2009; D07B 2201/2014; D07B 2201/2047; D07B 2201/2052; D07B 2201/2055; D07B 2201/2066; D07B 2201/2067; D07B 2201/2068; D07B 2201/2089; D07B 2201/209; Y10T 70/402

USPC ..... 70/14, 18, 19, 30, 49

See application file for complete search history.

(56) References Cited

U.S. PATENT DOCUMENTS

| | | | | |
|---|---|---|---|---|
| 3,756,008 | A | 9/1973 | Smith | |
| 4,570,465 | A | 2/1986 | Bennett | |
| 4,712,394 | A | 12/1987 | Bull | |
| 5,035,126 | A | 7/1991 | Biba | |
| 5,291,765 | A | 3/1994 | Hoisington | |
| 5,791,170 | A * | 8/1998 | Officer | E05B 67/003 70/14 |
| 6,006,555 | A | 12/1999 | Shu-Fen | |
| 7,412,854 | B2 | 8/2008 | Raemisch et al. | |
| 8,525,033 | B2 * | 9/2013 | Grether | D07B 1/02 174/128.1 |
| 8,604,927 | B2 * | 12/2013 | Sisney | G08B 13/1445 200/61.13 |
| 8,881,521 | B2 * | 11/2014 | Browne | D07B 1/0673 57/237 |
| 9,334,678 | B2 * | 5/2016 | Allen | E05B 67/003 |
| 2008/0072633 | A1 | 3/2008 | Samuel | |
| 2008/0276664 | A1 | 11/2008 | Shu | |
| 2011/0009876 | A1 * | 1/2011 | McAlister | A61B 17/221 606/128 |
| 2014/0077951 | A1 * | 3/2014 | Sisney | G08B 13/1445 340/568.2 |

* cited by examiner

*Primary Examiner* — Suzanne Barrett

(74) *Attorney, Agent, or Firm* — Taft Stettinius & Hollister LLP

(57) ABSTRACT

A twistable security cable including a cable and a coupling device. The cable includes a central core, two or more wire groups positioned about the central core, and an outer coating. The central core is structured to retain a shape to which it is deformed, and each of the wire groups includes two or more braided or twisted wires. The coupling mechanism is structured to selectively retain first and second ends of the cable in close proximity to one another.

20 Claims, 5 Drawing Sheets

TWISTABLE SECURITY CABLE

CROSS REFERENCE TO RELATED APPLICATIONS

The present application claims the benefit of U.S. Provisional Application No. 61/910,897 filed on Dec. 2, 2013, the contents of which are incorporated herein by reference in their entirety.

TECHNICAL FIELD

The present invention generally relates to cables, and more particularly, but not exclusively, to security cables.

BACKGROUND

Security cables are commonly used to attach a portable object to a large or stationary structure such that the object cannot be carried away from the structure. The security cables often include a wire rope coated with a layer of plastic to prevent the wire rope from damaging the object or the structure. FIG. 1 depicts a conventional cable 110 including a wire rope 112 and a coating 114. The wire rope 112 includes a plurality of wire groups 117, each of which includes a plurality of individual wires 118 which are braided or twisted together to form the cable 110.

Conventional security cables suffer from a variety of limitations, disadvantages and problems. In certain circumstances, it is desirable to not only prevent the portable object from being carried away from the structure, but also to prevent substantial movement of the object with respect to the structure. For example, when construction equipment is being transported on the exterior of a vehicle (e.g., on the roof of a van or in the bed of a pickup truck), the equipment must be tied down to ensure that it does not fall off or rattle while the vehicle is moving. Conventional tie-downs do not provide a reliable means of locking an object, and conventional security cables do not allow for sufficient twisting or bending to tightly secure the objects before locking. As such, it is common practice to use a security cable to prevent theft of the equipment, and a separate tie-down strap to prevent rattling or movement of the equipment. Therefore, a need remains for further improvements in security cable systems and methods.

SUMMARY

An exemplary security cable includes a cable and a coupling mechanism. The cable includes a plastically-deformable central core having shape retention characteristics, a plurality of wire groups positioned about the central core wherein each of the wire groups includes a plurality of wires, and a flexible outer coating surrounding the central core and the plurality of wire groups. The coupling mechanism is attached to first and second ends of the cable and is structured to selectively couple the first and second ends of the cable to one another, and wherein the coupling mechanism includes a lock. The cable is manually deformable to a plurality of shapes, and the central core is structured to substantially retain the cable in each of the plurality of shapes.

DETAILED DESCRIPTION OF ILLUSTRATIVE EMBODIMENTS

Figure 1:
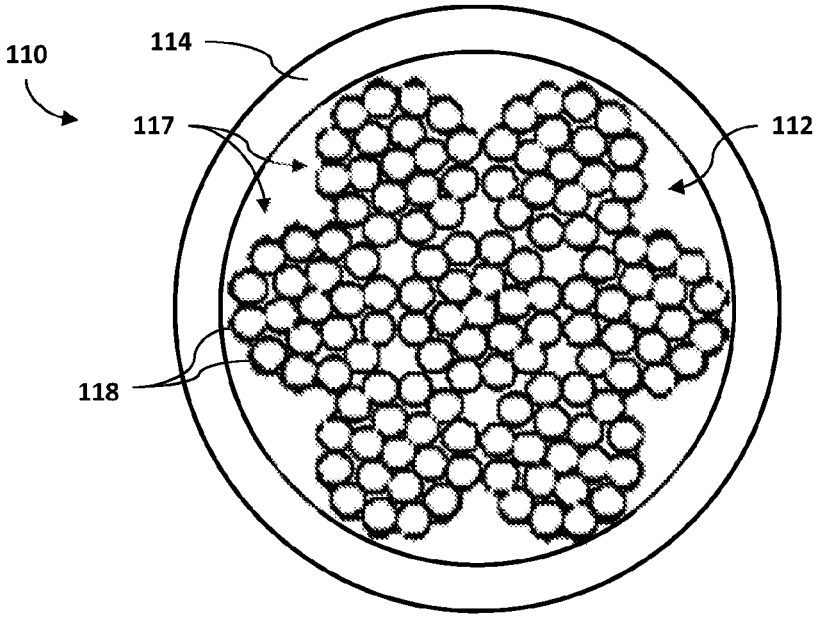
Fig. 1 (Prior Art)
FIG. 1 is a cross-sectional illustration of a conventional cable.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
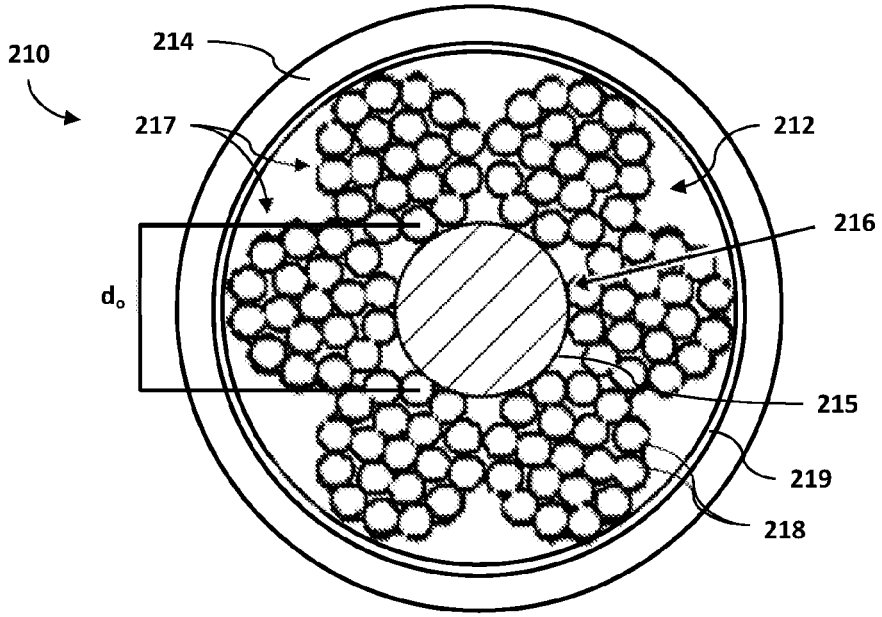
FIG. 2 is a cross-sectional illustration of a security cable according to one embodiment of the present invention.

With reference to FIG. 2, an exemplary coated cable 210 according to one embodiment includes a wire rope 212 and a protective coating 214 formed of a material such as, for example, a vinyl material. The wire rope 212 includes a central core 216 and a plurality of wire groups 217 surrounding the central core 216. Each of the wire groups 217 includes several individual wires 218 which are braided or twisted together. The wire groups 217 are in turn braided or twisted about the central core 216. In the illustrated embodiment, each of the outer wire groups 217 includes a number of wires 218 arranged in three concentric layers. It is also contemplated that the outer wire groups 217 could include any number and configuration of the wires 218.

The cable 210 has a high tensile strength and may be utilized, for example, as a towing cable or a security cable. Exemplary forms of the latter are described below with reference to FIGS. 3-6. In certain embodiments, the cable 210 may include high-strength fibers to increase the tensile strength of the cable 210. For example, the cable 210 may include a sheath 219 of woven high-strength fibers positioned between the protective coating 214 and the wire groups 217. The high-strength fibers may be formed of a material such as, for example, a nylon, a high-modulus polyethylene, or a para-aramid synthetic fiber such as polyparaphenylene terephthalamide (sold under the trademark KEVLAR®). In such embodiments, one or more of the wire groups 217 may include the high-strength fibers, or the high-strength fibers may be woven around the wire rope 212, and the coating 214 may seal the fibers and the wire rope 212 to provide protection from the elements.

In the illustrated embodiment, the core 216 is configured as a solid core formed of a ductile material having a high plastic deformation range, and is capable of being plastically-deformed and retaining a shape to which it is deformed. This feature is sometimes referred to as "shape memory". Thus, when the cable 210 is manually deformed to a particular shape, the core 216 will substantially retain the cable 210 in that shape until acted upon by an outside force. The term "substantially" as used herein may be applied to modify a quantitative representation which could permissibly vary without resulting in a change in the basic function to which it relates. For example, if a user bends a portion of the cable 210 upward, it will remain in substantially the same position until the user bends the cable 210 to a new shape. By contrast, the conventional wire groups 117 have no shape memory, and thus cannot hold the conventional cable 110 in a given configuration. While the illustrated solid core 216 is formed as a unitary, single piece, it is also contemplated that the core 216 may be formed from multiple pieces so long as the core 216 is capable of the shape retention/memory described above.

In the illustrated form, the outer diameter $d_o$ of the core 216 substantially corresponds to the outer diameter $d_o$ of each of the outer wire groups 217. In certain forms, the outer diameter $d_o$ of the core 216 may be substantially equal to the outer diameters $d_o$ of the outer wire groups 217. It is also contemplated that the core 216 may be of a lesser or greater outer diameter $d_o$ than that of the outer wire groups 217 such as, for example, in embodiments including more or fewer than six outer wire groups 217. Furthermore, while the illustrated core 216 is surrounded by a single layer of outer wire groups 217, it is also contemplated that that the outer wire groups 217 may be positioned about the core 216 in two or more concentric layers of outer wire groups 217.

The material and diameter $d_o$ of the core 216 may be selected based upon a number of factors such as, for example, flexibility, tensile strength, plastic deformation range, and fatigue limits. The material and diameter $d_o$ may be selected to allow the cable 210 to twist, bend back and forth multiple times, and retain its shape. In certain embodiments, the core 216 may include a friction-reducing coating 215 to facilitate the travel of the wires 218 across the surface of the core 216 when the cable 210 is twisted. In some embodiments, the core 216 is formed of a metallic material. In other embodiments, the core 216 is formed of a metallic material having shape memory or shape retention capabilities. In still other embodiments, the core 216 is formed of a shape-memory alloy material such as, for example, Nitinol. However, it should be understood that the core 216 may also be formed of other suitable materials.

Figure 3:
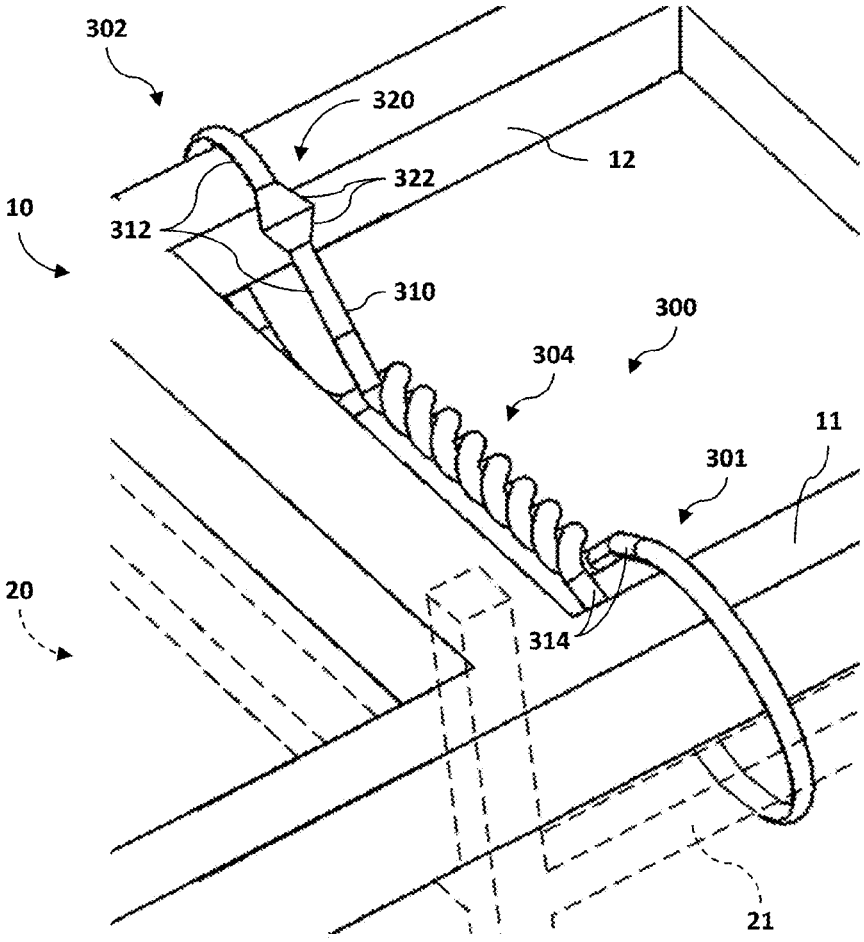
FIG. 3 illustrates an exemplary security cable attaching a portable object to a frame.

FIG. 3 depicts an exemplary security cable 300 illustrated to attach a portable object 10 to a stationary frame 20. In the illustrated form, the portable object 10 is a ladder, and the stationary frame 20 is an equipment rack on a vehicle. It is to be understood, however, that the security cable 300 may be utilized to prevent any number of portable objects from being carried away or removed from a stationary structure. In this context, "portable" and "stationary" are relative terms in that the portable object 10 is much easier for an unauthorized person to move than the stationary frame 20. Thus, while the illustrated frame 20 is attached to a movable vehicle, the frame 20 may still be considered "stationary" as used herein.

The security cable 300 includes a cable 310 of the type illustrated in FIG. 2 and described above, and a coupling 320 connecting the two cable ends 312 to one another. The coupling 320 includes two coupling portions 322, each of which is attached to one of the cable ends 312. When the coupling portions 322 are attached to one another, the coupling 320 selectively prevents separation of the two portions 322, thereby maintaining the cable ends 312 in close proximity to one another. It should be appreciated that the coupling 320 is illustrated in schematic form since many configurations of couplings are contemplated for use with the security cable 300. Illustrative forms of the coupling 320 are described below with reference to FIGS. 4-6.

In order to secure the object 10 to the frame 20, a user may wrap the cable 310 around a first object portion 11 and a first frame portion 21, thereby forming a first loop 301. Once the first loop 301 is formed, the cable 310 can effectively be considered as being divided into two segments 314. The user may then twist the two segments 314 together, thereby tightening the loop 301 and forming a twisted section 304. Once the loop 301 is of a desired tightness, the user forms a second loop 302 around a second object portion 12. Due to the shape-retaining or shape-memory properties of the cable 310, the security cable 300 will substantially remain in the selected shape and configuration, even if the user releases one or both ends 312 of the cable 310, for example, to connect the coupling portions 322 to one another.

After the second loop 302 is formed, the user may connect the coupling portions 322 to one another, thereby locking the object 10 to the frame 20. When the loops 301, 302 are of a proper tightness, the security cable 300 retains the object 10 snugly against the frame 20 (due in part to the shape-retention or shape-memory of the cable 310), thereby reducing rattling which may otherwise occur during operation of the vehicle. If the user determines that the object 10 is connected to the frame 20 too loosely (for example, as depicted in FIG. 3) or too tightly, the user may disconnect or disengage the coupling 320 and twist the segments 314 to adjust the number of turns in the twisted section 304, thereby tightening or loosening the first loop 301. When the coupling portions 322 are reconnected or reengaged, the second loop 302 will also be looser or tighter, depending upon whether turns were added to or removed from the twisted section 304.

While the foregoing description relates to an exemplary method of securing the object 10 to the frame 20, it is to be understood that the precise method used may depend on a number of factors such as, for example, user preference and the particular shape/configuration of the object 10, the frame 20, and/or the coupling 320. For example, in certain embodiments, each of the first and second loops 301, 302 may be formed around at least one of an object portion and a frame portion so long as both the object 10 and the frame 20 include a portion positioned within one of the loops 301, 302. In other embodiments, one of the loops 301, 302 may be formed around a portion of the object 10, and the other of the loops 301, 302 may be formed around a portion of the frame 20. In further embodiments, one of the loops 301, 302 may be formed around both an object portion and a frame portion, and the other of the loops 301, 302 may be formed around another portable object and/or stationary frame.

Figure 4:
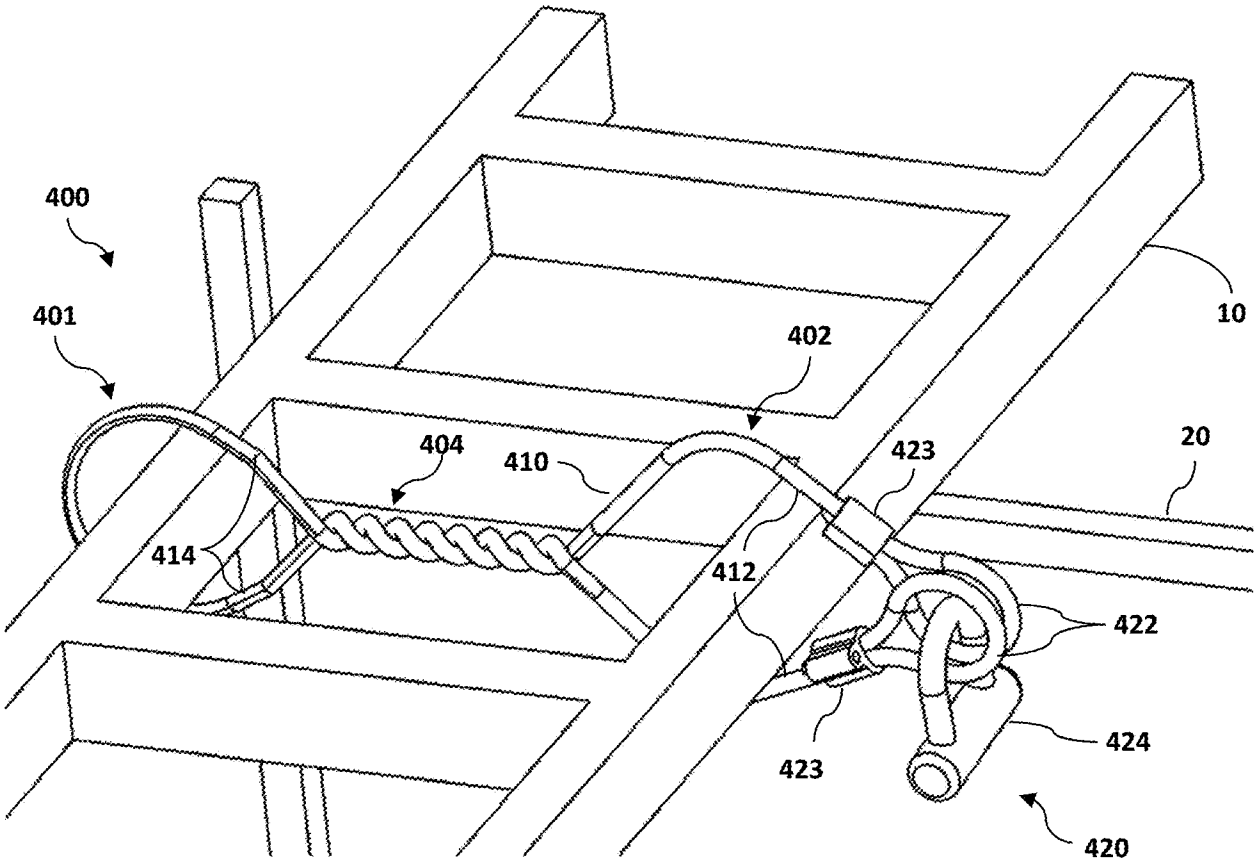
FIGS. 4-6 depict security cables according to other embodiments of the present invention.
Figure 5:
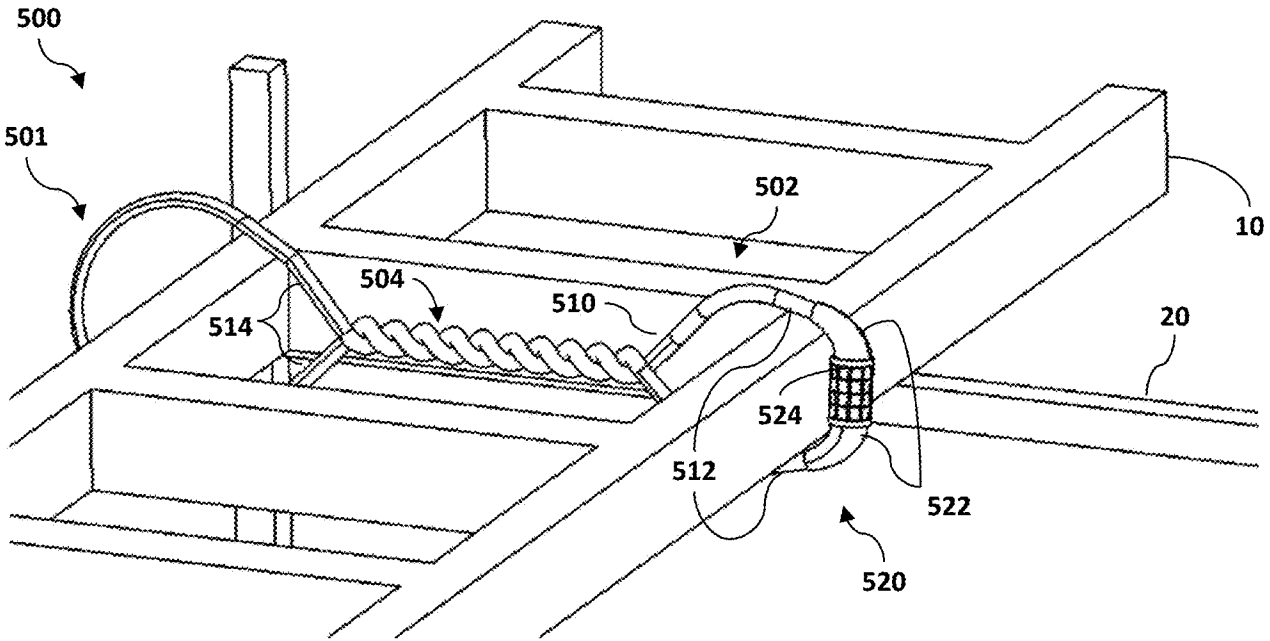
Figure 6:
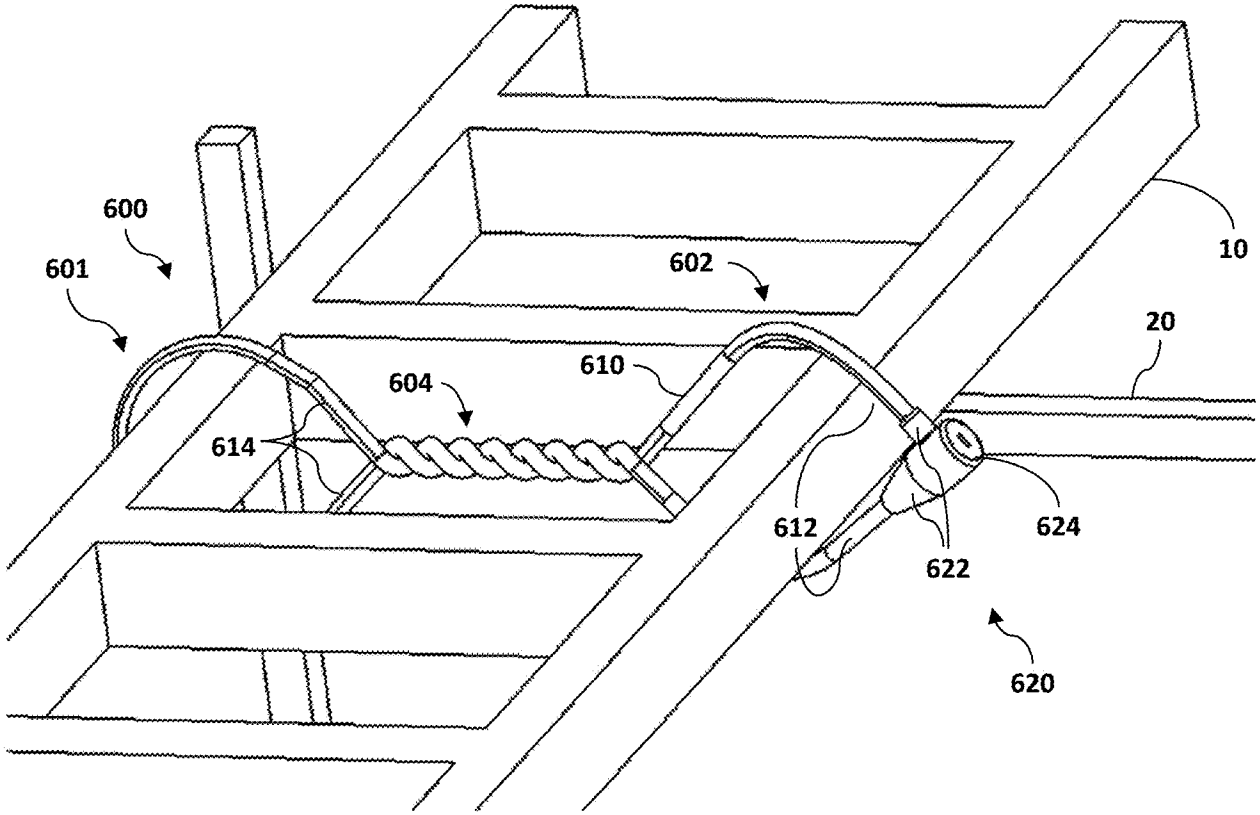

FIGS. 4-6 depict exemplary modifications and other configurations and embodiments of the security cable 300. It should be understood that like reference characters between the embodiment illustrated in FIG. 3 and the embodiments illustrated in FIGS. 4-6 make reference to similar elements and features. Each of the security cables described hereinafter is substantially similar to the security cable 300. In the interest of conciseness, the following descriptions focus primarily on the differences between the illustrated security cables and the previously-described security cable 300.

FIG. 4 illustrates a security cable 400 including a padlock-type coupling 420. Each of the cable ends 412 is formed into an end loop 422. Collars 423 may be crimped or swaged onto the cable 410 to hold and maintain the end loops 422 in a looped configuration. In certain forms, the cable ends 412 may pass through the collar 423 three or more times such as, for example, as described in a commonly owned and co-pending application entitled MULTI-PASS CRIMP COLLAR FOR A LOOPED CABLE and filed on Dec. 2, 2014 (U.S. patent application Ser. No. 14/558,230), the contents of which are hereby incorporated by reference in their entirety. Once the second security cable loop 402 is formed, the shackle of a padlock 424 may be passed through the end loops 422 and locked to the padlock body. In this configuration, the end loops 422 are coupled to one another through the padlock 424, thereby preventing unauthorized removal of the security cable 400. While the padlock 424 is illustrated as a key-operable padlock, it is also contemplated that other forms of padlocks may be utilized such as, for example, combination padlocks.

FIG. 5 depicts a security cable 500 including a combination lockhead coupling 520. The lockhead coupling 520 includes a pair of lockheads 522, each of which is coupled to one of the cable ends. The lockheads 522 remain coupled to one another until a proper combination is selected on an interface 524. As such, when the security cable 500 is installed and the lockheads 522 are coupled, a user cannot remove the security cable 500 without entering the proper combination on the interface 524.

FIG. 6 illustrates a security cable 600 including a keyed lockhead coupling 620. Each of the cable ends 612 is coupled to a lockhead 622, and the lockheads 622 are configured to remain coupled until a locking plug 624 is actuated by a proper key. As such, when the security cable 600 is installed and the lockheads 622 are coupled, a user cannot remove the security cable 600 without utilizing a proper key with the locking plug 624.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A security cable, comprising:

a cable including:

a plastically-deformable central core having shape retention characteristics;

a plurality of wire groups positioned about the central core, wherein each of the wire groups includes a plurality of wires; and a flexible outer coating surrounding the central core and the plurality of wire groups; and a coupling mechanism attached to first and second ends of the cable and structured to selectively couple the first and second ends of the cable to one another, the coupling mechanism including a lock; and wherein the cable is manually deformable to a plurality of shapes, and wherein the central core is structured to substantially retain the cable in each of the plurality of shapes.

2. The security cable of claim 1, wherein the first and second ends of the cable are coupled together by the coupling mechanism to form a loop, and wherein the coupling mechanism forms a portion of the loop.

3. The security cable of claim 1, wherein the lock comprises a padlock.

4. The security cable of claim 1, wherein the lock includes a first lockhead coupled to the first end of the cable, and a second lockhead coupled to the second end of the cable; and wherein the first and second lockheads have a locked state in which the lockheads are selectively coupled to one another, and an unlocked state in which the lockheads are selectively separable from one another.

5. The security cable of claim 4, wherein the lock comprises a key-operated lock.

6. The security cable of claim 4, wherein the lock comprises a combination lock.

7. The security cable of claim 1, the cable further including a sheath of woven high-strength fiber positioned between the flexible outer coating and the plurality of wire groups.

8. The security cable of claim 1, wherein the coupling mechanism comprises means for selectively coupling and decoupling the first and second ends of the cable.

9. The security cable of claim 1, further comprising a friction-reducing coating on an outer surface of the central core.

10. The security cable of claim 1, wherein each of the wire groups has a first outer diameter, and the central core has a second outer diameter substantially corresponding to the first outer diameter.

11. The security cable of claim 10, wherein the second outer diameter is substantially equal to the first outer diameter.

12. The security cable of claim 1, wherein the central core of the cable comprise a unitary solid core.

13. The security cable of claim 1, wherein the central core is formed of a ductile material having a high plastic deformation range to provide the shape retention characteristics.

14. The security cable of claim 1, wherein the security cable has a manually deformed state defining one of the plurality of shapes, and wherein the central core is structured to substantially retain the shape-retaining security cable in the manually deformed state.

15. The security cable of claim 1, wherein the shape retention characteristics of the central core comprise shape memory characteristics.

16. The security cable of claim 15, wherein the central core is formed of a shape memory material.

17. A method of securing a portable object to a stationary structure, the method comprising:

wrapping a first segment of a security cable around a first portion of the object and a first portion of the structure, wherein the security cable is structured to retain a shape to which it is deformed;

forming a first loop around the first portion of the object and the first portion of the structure by bringing the first segment of the security cable into contact with a second segment of the security cable;

twisting the first and second segments of the security cable about one another, thereby tightening the first loop and forming a twisted section of the security cable;

forming, with the first and second segments of the security cable, a second loop around at least one of a second portion of the object and a second portion of the structure; and selectively coupling a first end of the security cable to a second end of the security cable with a coupling device, thereby selectively securing the object to the structure.

18. The method of claim 17, further comprising:

determining if the first loop is of a desired tightness; and in response to determining that the first loop is not of the desired tightness, adjusting the tightness of the first loop, the adjusting comprising:

decoupling the first and second ends of the security cable;

twisting the first and second segments of the security cable about one another in a direction corresponding to whether more or less tightness is desired;

reforming the second loop around the at least one of the second portion of the object and the second portion of the structure; and recoupling, with the coupling device, the first end of the security cable with the second end of the security cable.

19. A security cable, comprising:

a shape-retaining security cable having a first end and an opposite second end, including:

a plastically-deformable central core having an outer core diameter; and a plurality of wire groups circumferentially surrounding the central core, each of the wire groups comprising a plurality of wires, and wherein each of the wires has an outer wire diameter that is less than the outer core diameter; and a coupling device including a lock structured to selectively couple the first end of the security cable to the second end of the security cable; and wherein the shape-retaining security cable has a manually deformed state defining one of a plurality of shapes, and wherein the central core is structured to substantially retain the shape-retaining security cable in the manually deformed state.

20. The security cable of claim 19, wherein the shape-retaining security cable includes a first segment and a second segment; and wherein, in the deformed state, the first and second segments are tightly twisted about one another to form a tightly twisted cable section, and the central core is structured to resist untwisting of the tightly twisted cable section.

* * * * *